US010259675B2

(12) United States Patent
DeMarco et al.

(10) Patent No.: US 10,259,675 B2
(45) Date of Patent: Apr. 16, 2019

(54) CUTTING EQUIPMENT AND METHOD FOR CONTINUOUS PAPER STRIPS WITH IMAGES ARRANGED ALONG MULTIPLE ROWS

(71) Applicant: Tecnau S.r.l., Ivrea (TO) (IT)

(72) Inventors: Giuliano DeMarco, Ivrea (IT); Armando Aprato, Ivrea (IT); Francesco Terrusi, Ivrea (IT); Francesco Modica, Ivrea (IT)

(73) Assignee: Tecnau S.R.L., Ivrea (TO) (IT)

( * ) Notice: Subject to any disclaimer, the term of this patent is extended or adjusted under 35 U.S.C. 154(b) by 768 days.

(21) Appl. No.: 14/064,740

(22) Filed: Oct. 28, 2013

(65) Prior Publication Data

US 2014/0116212 A1 May 1, 2014

(30) Foreign Application Priority Data

Oct. 29, 2012 (IT) ..... TO2012A0955

(51) Int. Cl.

| | |
|---|---|
| ***B41J 11/70*** | (2006.01) |
| ***B65H 35/06*** | (2006.01) |
| ***B65H 35/02*** | (2006.01) |
| ***B65H 35/04*** | (2006.01) |

(52) U.S. Cl.

CPC ..... *B65H 35/06* (2013.01); *B65H 35/02* (2013.01); *B65H 35/04* (2013.01); *B65H 2511/11* (2013.01); *B65H 2701/1313* (2013.01); *Y10T 83/04* (2015.04); *Y10T 83/536* (2015.04)

(58) Field of Classification Search

CPC ..... B41J 11/663; B41J 11/70; B41J 11/68; B65H 2511/10; B65H 35/02; B65H 35/04

USPC ..... 83/948

See application file for complete search history.

(56) References Cited

U.S. PATENT DOCUMENTS

| | | | | | |
|---|---|---|---|---|---|
| 1,579,786 | A * | 4/1926 | Ryberg | B26D 1/205 | 242/530 |
| 3,765,583 | A * | 10/1973 | Mathes | G03B 35/24 | 226/116 |
| 3,971,281 | A * | 7/1976 | Bredow | B23D 15/002 | 83/519 |
| 4,151,770 | A * | 5/1979 | D'Angelo | B26D 7/025 | 226/110 |

(Continued)

*Primary Examiner* — Sean Michalski
*Assistant Examiner* — Fernando Ayala
(74) *Attorney, Agent, or Firm* — Banner & Witcoff, Ltd.

(57) ABSTRACT

A cutting equipment for continuous paper strips having images arranged in sequence along multiple rows comprising a longitudinal cutting mechanism for separating the rows from the strips and a transversal cutting mechanism for separating image sheets from the rows and in which the image sheets have different longitudinal dimensions and possibility of random variations between row and row, The equipment further comprises individual feeding mechanisms for feeding, in an independent way, the rows with respect to the transversal cutting mechanism; a buffer device, of compensation for the different feeds of the rows, and an electronic control unit for actuating the feeding mechanisms and the transversal cutting mechanism so as to present the trailing edges of said image sheets in alignment for a simultaneous cutting by the transversal cutting mechanism and extracting one or more images from the cutting mechanism, after its actuation, as preparation of collecting.

23 Claims, 9 Drawing Sheets

(56) References Cited

U.S. PATENT DOCUMENTS

| | | | | | |
|---|---|---|---|---|---|
| 4,161,899 | A * | 7/1979 | Strunc | B26D 5/34 | 700/167 |
| 4,463,677 | A * | 8/1984 | Kuehfuss | B23D 33/12 | 101/483 |
| 4,846,037 | A * | 7/1989 | Tobita | B23D 15/06 | 83/599 |
| 5,156,384 | A * | 10/1992 | Donahue | B42C 1/00 | 270/58.31 |
| 5,896,797 | A * | 4/1999 | Thompson | B65H 35/02 | 83/155 |
| 6,360,638 | B1 * | 3/2002 | White | B65H 23/1886 | 83/13 |
| 2002/0062723 | A1 * | 5/2002 | Marocco | B23D 45/003 | 83/13 |
| 2003/0107640 | A1 * | 6/2003 | Chang | B41J 11/008 | 347/107 |
| 2003/0126962 | A1 * | 7/2003 | Bland | B41J 11/46 | 83/13 |
| 2003/0164103 | A1 * | 9/2003 | Lamothe | B65H 20/02 | 101/227 |
| 2004/0244550 | A1 * | 12/2004 | De Marco | B65H 20/22 | 83/24 |
| 2005/0211042 | A1 * | 9/2005 | Kikuchi | B26D 1/08 | 83/613 |
| 2010/0175521 | A1 * | 7/2010 | Dubesset | B26D 5/005 | 83/13 |
| 2012/0222528 | A1 * | 9/2012 | Krohnert | B65H 20/32 | 83/24 |

* cited by examiner

CUTTING EQUIPMENT AND METHOD FOR CONTINUOUS PAPER STRIPS WITH IMAGES ARRANGED ALONG MULTIPLE ROWS

RELATED APPLICATION

This application claims priority to Italian Application No. TO2012A000955 filed Oct. 29, 2012, and entitled "Cutting equipment and method for continuous paper strips with images arranged along more rows", the content of which is incorporated herein by reference in its entirety.

FIELD OF THE INVENTION

The present invention relates to an equipment and a method for cutting continuous paper strips with images arranged along multiple rows.

More specifically, the invention relates to an equipment and a method for cutting continuous paper strips with images arranged in sequence, along two or more rows and dimensions identified by codes.

BACKGROUND OF THE INVENTION

Cutting equipments for paper strips with sequential images found particular application for industrial printing of high productivity of photos from digital files.

The photo shooting with the current digital equipment, such as cameras, mobile phones, smartphones etc., have increased the number of photographs taken every day at enormously high values. Only a small part of the "shots" is processed for printing. Nevertheless, the number of print copies is very high and the sector of the photo printing is in constant development and is favorably influenced by reduction in costs and prompt execution of customer orders. To obtain these results, photo prints are often carried out by centralized services with orders processed via internet.

In this context, great chances of success have digital printing techniques, as the color inkjet technologies, less costly and complex and faster than traditional photographic technologies. In analogy to what occurs for the automatic processing of documents, systems for the printing of photographic images are in development, which use specialized high-speed printers and paper supports constituted by strips wrapped in big reels. On the basis of orders/customers, the images of the respective digital files are printed on the paper strips unwinding from the reels. Thereafter, the strips are rewound and transferred to cutting equipments for the cutting and the separation of the images as printed copies, with gathering by customer order and dispatch to the customers.

Traditionally, the cost of the print in industrial high production printing plants is influenced by the number and not by the length of the printed "lines". It causes to executing prints on wide strips, which are split longitudinally in a stage subsequent to the printing stage for obtaining, at a reduced cost, more products in parallel.

The use of paper strips to be divided into image rows is also advantageous for the obtainable speeds and, from a cost and logistics point of view, for the number of strip reels to be treated, reduced with respect to the number of strip reels having a single row of images The advantages are particularly appreciable when the images have a same width (height), as is the case of "standard" prints of 100×150 mm or 100×130 mm, in which the images have the leading edges and the trailing edges in alignment, allowing a simultaneous cutting of the various rows.

By using suitable codes associated to the size of the images and machine readable is also possible to provide paper strips with images of different sizes, but the joint cutting of the row would only be possible when all the images of the rows have the same length. Otherwise, the images of dimensions different from the previous ones in the sequence should be printed in successive positions of the strip, while the not used parts of strip of the other rows would be discarded.

A problem of industrial photographic prints on continuous paper strips is the processing of image digital files in which the ratio between length and width is variable due to a user setting in a shooting phase or in a subsequent processing. Another problem concerns the processing of "panoramic" images, i.e. with a strong relationship between length and width, achieved through several shots with different angles and software merged in a single file.

The provision of identification codes machine readable for the sizes of the print copies and appropriate software enables the industrial printing on paper strips of multiple rows with images of different lengths, "panoramic" images and standard" images. However, this would lead to a completely unacceptable waste of paper for the rows sided to the images of larger length.

SUMMARY OF THE INVENTION

An object of the present invention is therefore to provide an equipment and a method for cutting, at high-speed and limited cost, continuous paper strips with images arranged in sequence along two or more rows and enabling the separation of images with different lengths also with random differences in the lengths of images of a row compared to those of the other rows.

This problem is solved by the equipment for cutting continuous paper strips having images arranged in sequence along multiple rows and dimensions identified by image codes, comprising a longitudinal cutting mechanism for separating the rows from said strips, a transversal cutting mechanism actuatable for separating image sheets with the respective images from the rows, and extracting members for extracting the images from the transversal cutting mechanism, and wherein said image sheets define trailing edges along said rows. The transversal cutting equipment is employable with paper strips in which the image sheets have different longitudinal dimensions and possibility of random variations between row and row, and the cutting equipment further comprises: individual feeding mechanisms for feeding, in an independent way, the rows with respect to the transversal cutting mechanism after the separation of the image sheets; a buffer device, upstream of the individual feeding mechanisms, of compensation for the different feeds of the rows, and an electronic control unit for actuating the feeding mechanisms and the transversal cutting mechanism so as to present the trailing edges of said image sheets in alignment for a simultaneous cutting by the transversal cutting mechanism and for extracting one or more images from the cutting mechanism, after its actuation, as preparation of collecting.

The cutting method involves the use of continuous paper strips with images arranged along several rows and dimensions identified by codes and possibility of longitudinal dimensions differentiated and random variations among the rows. The method provides feeding, in an independent way, the rows after the separation of the image sheets; a buffer device, upstream of the transversal cutting mechanism, to compensate for the different feeds of the rows; and actuating the feeding mechanisms and the transversal cutting mechanism as a function of the codes of the images to be separated and so as to present the image sheets of the rows with aligned trailing edges for a simultaneous cutting by the transversal cutting mechanism.

BRIEF DESCRIPTION OF THE DRAWINGS

The characteristics of the invention will become clear from the following description given purely by way of non-limiting example, with reference to the appended drawings in which.

DESCRIPTION OF THE PREFERRED EMBODIMENTS

Figure 1:
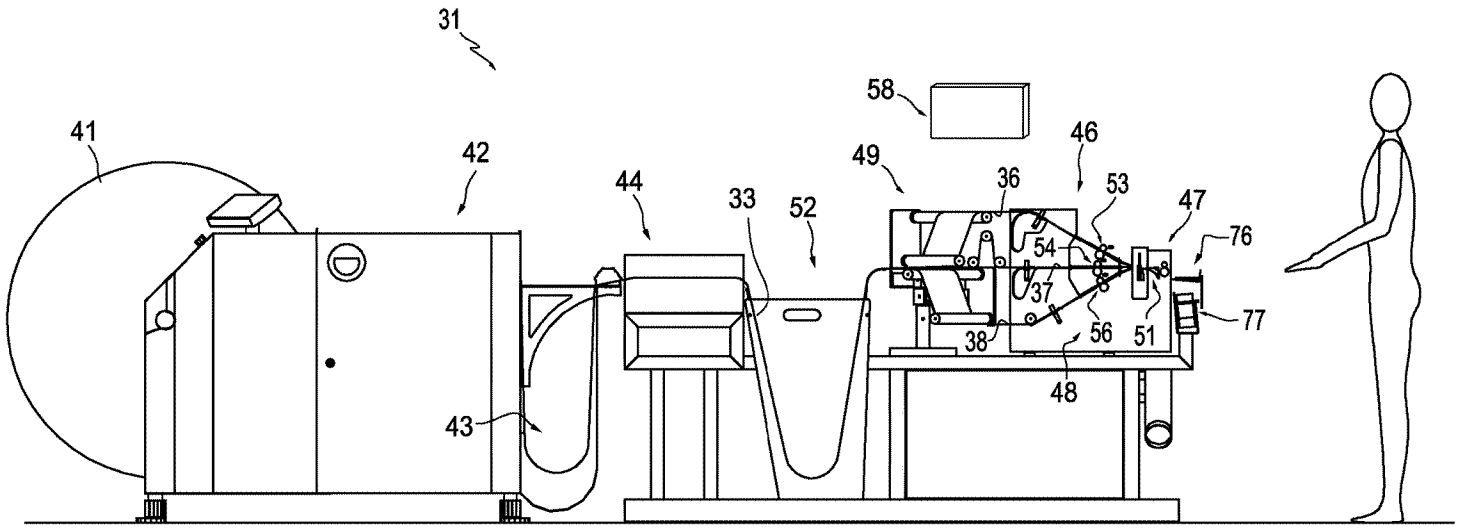
FIG. 1 represents a schematic side view of a cutting equipment for continuous paper strips with images arranged along multiple rows, in accordance with a first embodiment of the invention.
Figure 3:
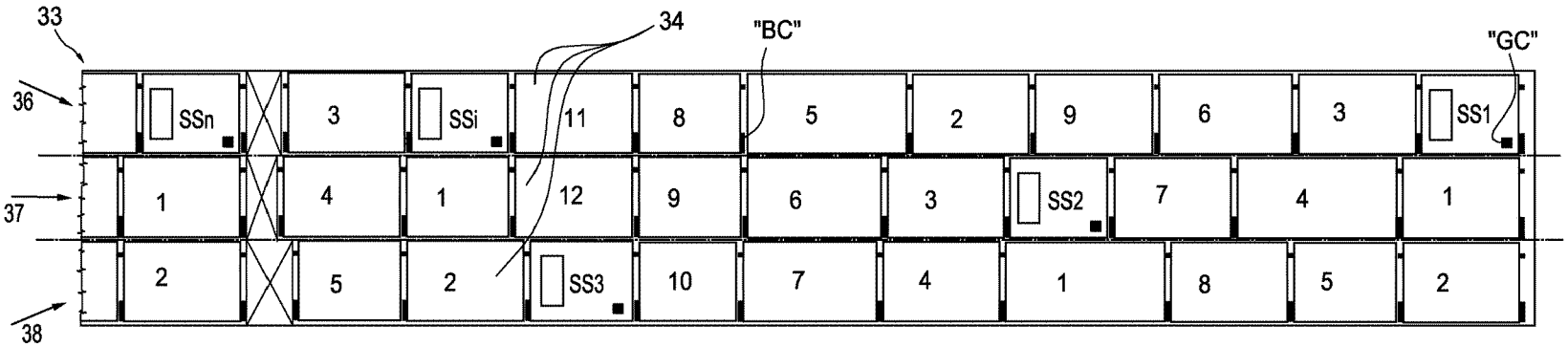
FIG. 3 shows a diagram of a continuous paper strip with arrangement of images along multiple rows, in accordance with the invention.
Figure 3A:
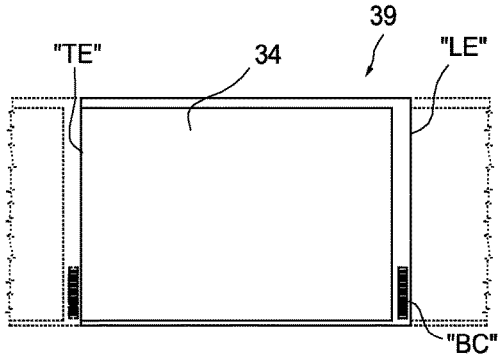
FIG. 3*a* is a detail, in enlarged scale, of the paper strip of FIG. 3.
Figure 6:
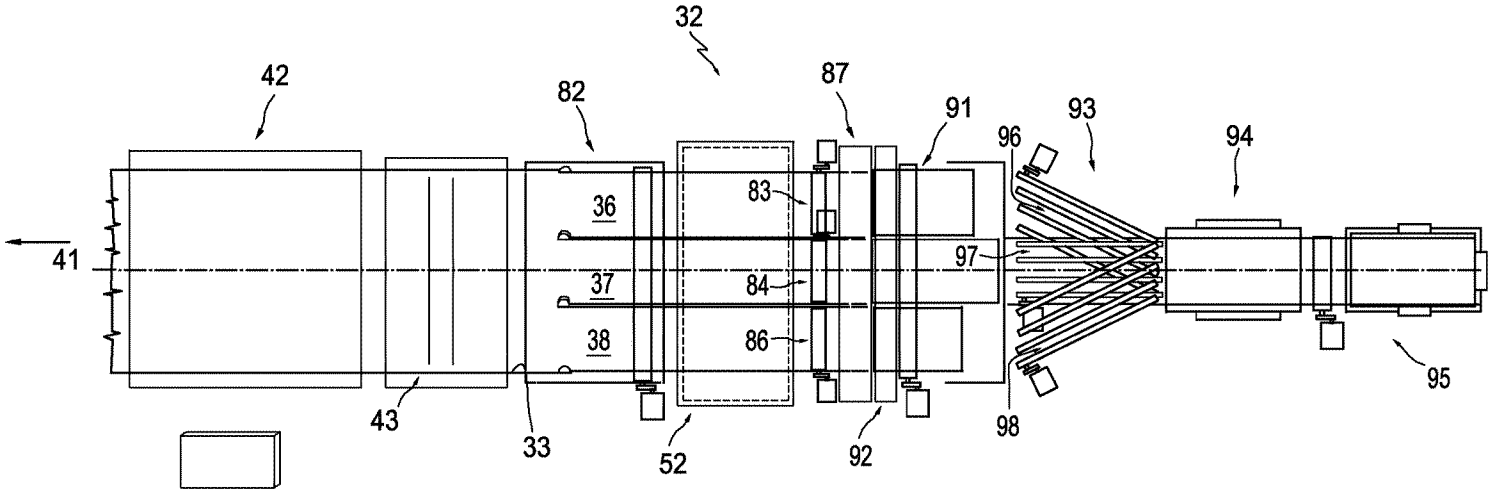
FIG. 6 is a schematic plan view of a cutting equipment for continuous paper strips, in accordance with a second embodiment of the invention.

A cutting equipment 31 and a cutting equipment 32 are represented, respectively, in FIGS. 1 and 6 for operating on continuous paper strips 33 in accordance with a first embodiment and a second embodiment of the invention. Images 34 (see FIG. 3*a*) are printed on the paper strip 33, arranged in sequence, for example at "slalom", along more rows (three in the figures) 36, 37, and 38. The images 34 have dimensions identified by image codes "BC" and constitute the print copies for the customer, of larger image sheets 39.

According to a typical arrangement, the image sheets 39 are grouped along the paper strips 36 in corresponding customers groups. The image sheets 39 are printed together with respective separating sheets "SS1", "SS2", . . . , "SSi", . . . , "SSn" and are identified by group codes. The group codes can be, for example, of matrix-type (Datamatrix) and optionally associated to starting group codes.

Alternatively, the group codes associated to the various customers/orders can be included in a database of the system to which the cutting equipment 31, 32 is connected and in association with the distribution of customer groups along the paper strip 33. In turn, the order/customer groups occupy sections of predetermined lengths of the paper strip 33, known as "spread", for example of 1 m, with transversely aligned leading and trailing edges.

The paper strips 33 are wound on large reels 41 coming from high speed printers, not shown in the figures, which also provide for the printing of the various codes. An unwinding device 42 provides to unwind the paper strip 33 and to feed the cutting equipment 31, 32 leaving a loop 43 of compensation for temporary speed differences during the movement of the paper strip 33.

In accordance with the invention, the cutting equipment 31, 32 is provided for operating on paper strips 33 in which the image sheets 39 have longitudinal dimensions of different extensions and possibility of random changes between one row and another of the paper strip 33. Consequently, leading edges "Le" and trailing edges "Te" of the image sheets 39 are generally misaligned.

The leading edges of the image 34 are spaced away from the leading edges "Le" of the image sheets 39, while the trailing edges of the image 34 correspond to the trailing edges "Te" of the image sheets 39. The image codes "BC" can be constituted by "bar codes" printed in the spaces of separation between the leading edges "Le" of the image sheets 39 and the leading edges of the respective image 34. Alternatively, the image codes "BC" can be printed in side spaces (to be trimmed) adjacent to the lateral edges of the images 34. Further, according to other alternatives, the image codes are printed on the separating sheets "SS1", "SS2", . . . , "SSi", . . . , "SSn" or, more generally, can be stored in a data bank of the system in association with the distribution of the images 34 in the group they belong.

The cutting equipment 31, in accordance with the first embodiment of the invention, comprises a longitudinal cutting mechanism 44, a transversal cutting mechanism 46 and extracting members 47. The longitudinal cutting mechanism 44 has the function of separating the rows 36, 37, 38 from the paper strips 33, and trimming the side edges of the row up to the final width of the print copies 34 directed to the customers.

The transversal cutting mechanism 46 is of a "Three-up" type comprising a "triple cutter" 48 which operates on the row 36, 37, 38 of the paper strip 33 in an overlapping condition. The cutter 48 is currently manufactured by Tecnau Srl and has been described in Italian Patent It 1,266,919 (Ep 0 701 901) and/or in the Italian Patent It 1,360,399 (Ep 1 741 653) of Tecnau Srl.

A readdressing device 49 moves the rows 36, 37, 38 from the condition of left flanking, central flanking and right flanking, downstream of the longitudinal cutting mechanism 44, to a condition of top, central and bottom overlapping, at the input of the "triple cutter" 48.

The transversal cutting mechanism 46 is actuatable for separating from the rows 36, 37, 38 the image sheets 39 with the respective images 34 of the print copies. The mechanism 46 further provides to eliminate the spaces of paper strip (Gutter) between the inlet edge and the trailing edge of two contiguous image sheets 39 of a same row, of separation between the images 34 and including the print of the image code "BC". In turn, the extracting members 47 are provided for extracting the print copies from the transversal cutting mechanism 46 after its actuation. A waste eliminating mechanism 51 is also associated to the cutting mechanism 46 for the parts of the strips 32 trimmed from the image sheets 39. For example, the mechanism 51 includes waste deflectors for separating and collecting in a container (not shown) the trimmed waste and the sections of paper strip at the end of the "spread" or voids.

The rows 36, 37, 38 are of a same width and, for example, for a paper strip of 330 mm (12.6"), the rows and the image sheets 39 have a width of 101.6 mm (4"), after trimming by the mechanism 46.

Figure 1A:
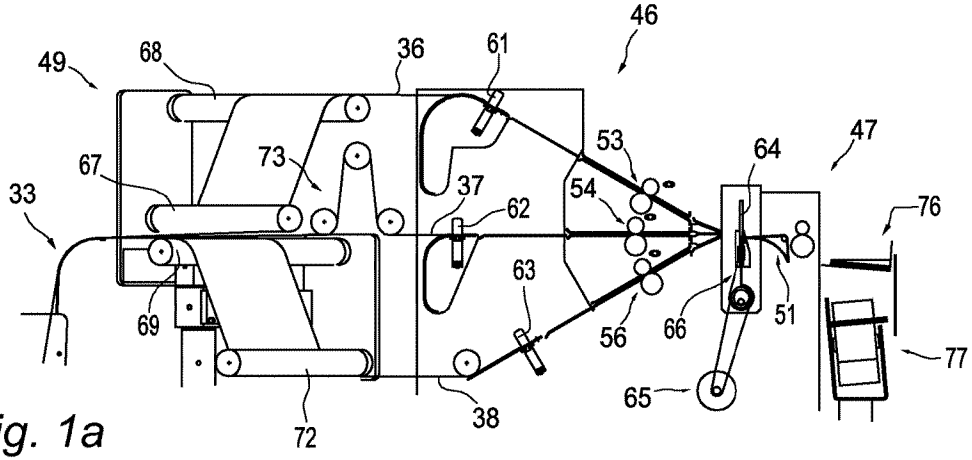
FIG. 1*a* shows some details, in enlarged scale, of the cutting equipment of FIG. 1.
Figure 2:
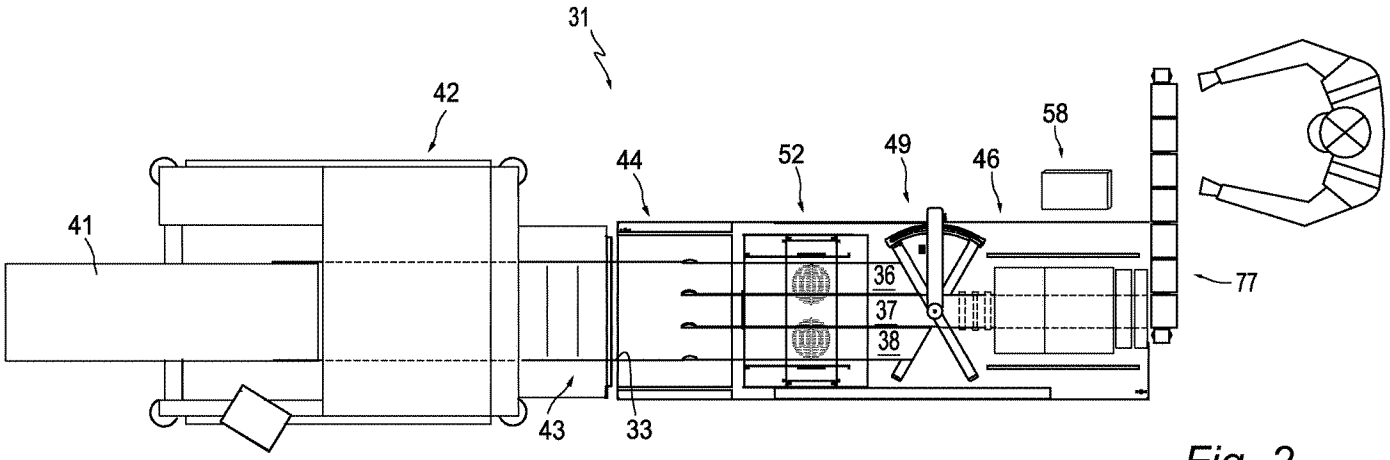
FIG. 2 is a plan view of the cutting equipment of FIG. 1.

In accordance with the invention, the equipment 31 comprises a buffer device 52, individual feeding mechanisms 53, 54 and 56 for the paper strip 33, of feeding for the cutting mechanism 46 and a control electronic control unit 58. The individual feeding mechanisms 53, 54 and 56 are actuatable for independently advancing the row 36, 37, 38 with respect to the cutting mechanism 46 after the separation of the image sheets 39, while the buffer device 52 is arranged upstream of the individual feeding mechanisms 53, 54 and 56 and has the function of compensating for the different feeds of the rows 36, 37, 38. Among the various components of the equipment 31, optical readers 61, 62, 63 (see FIG. 1*a*) are provided for reading the codes of the paper strip 33.

The "triple cutter" 48 provides a transverse blade 64 of "guillotine" type. The blade 64 is actuated, via a kinematic 66 including an eccentric member and a connecting rod, by a closed-loop servo-motor 65 controlled by the electronic unit 58. In particular, the blade 64 includes double cutting edges suitably inclined for the cutting from a side to another the rows 36, 37, 38. A cutter with a blade of this type is described, for example, in the Italian Patent It 1,344,190 (Ep 1 479 628) of Tecnau Srl. With this blade, a single cut can eliminate the spaces of paper strip (Gutter) between the adjacent images in the same row and including the image codes "BC".

It is clear that, in alternative to the "guillotine" blades 64, blades of different types, such as a circular knife blades and progressive cut or helical rotary blades can be suitably used.

The buffer device 52 is of known loop type, and in which the length of the loop may vary as function of the cut of image sheets with different length and on completion of a series. The compensation allows a selective arrest of a row or rows of the paper strip including image sheets 39 not belonging to the same series of the other images, without any waste of the paper strip 33.

The readdressing device 49 comprises a pair of diverter rollers 67 and 68 for moving and deviating, upward to the right, the left row 36, a pair of diverter rollers 69 and 72 for moving and deviating, downward to the left, the right row 38, and a group of compensating rollers 73 for moving the central row 37 not subject to lateral deviations. The pairs of diverter rollers are suitably reconfigurable for changing the overlapping condition of the rows according to a "progressive" or "regressive" arrangement of the images 34 among the rows 36, 37 and 38 of the paper strip 33.

The individual feeding mechanisms 53, 54 and 56 operate on the rows 36, 37 and 38 of the paper strip 33 outgoing, in overlapping condition, from the readdressing device 49. The electronic control unit 58 is designated for actuating the feeding mechanisms 53, 54 and 56 and the transversal cutting mechanism 46 in response to the read codes of the images to be separated in order to present the image sheets 39 of the rows with the respective trailing edges "TE" aligned and in a predetermined cutting position with respect to the cutting mechanism 46. It ensures a simultaneous cutting by the transversal cutting mechanism regardless of the length of the images. The cut is followed by the extraction of the print copies from the cutting mechanism 46, after its actuation, by the extracting members 47 and control by the electronics unit 38, in preparation of the collection regarding the associated order/customer.

Specifically, the image sheets 39 of the rows 36, 37 and 38 will be positioned, with the respective leading edges "LE" and trailing edges "TE", between the two cutting edges of the blade 64. With the actuating of the blade 26, the spaces of strip (Gutter) and the image code "BC" between the trailing edges "TE" of given image sheets 39 and images 34 and the leading edges of the following images 34 are also eliminated.

Alternatively, instead of a double edge cutting the cutting equipment of the invention can provide a blade with a single cutting edge and a repeated cutting cycle after advancing the strip 33 for the recovery of the spaces of the strip between the images 34 of the sequence.

The equipment 31 further includes a collecting and stacking device 76 and a conveyor belt 77, also controlled by the electronic unit 58, and in which the conveyor belt 77 has a feed direction transversal to that of the continuous strip 33 through the cutting mechanisms 44 and 46. The collecting and stacking device 76 responds to the group codes to collect, in an individualized mode, the print copies belonging to a same group (order/customer), while the conveyor belt 77 transfers the collected group of print copies to other devices of the system for any finishing and envelope insertions. These devices, of known type, are herein not described since external to the present invention.

Figure 4:
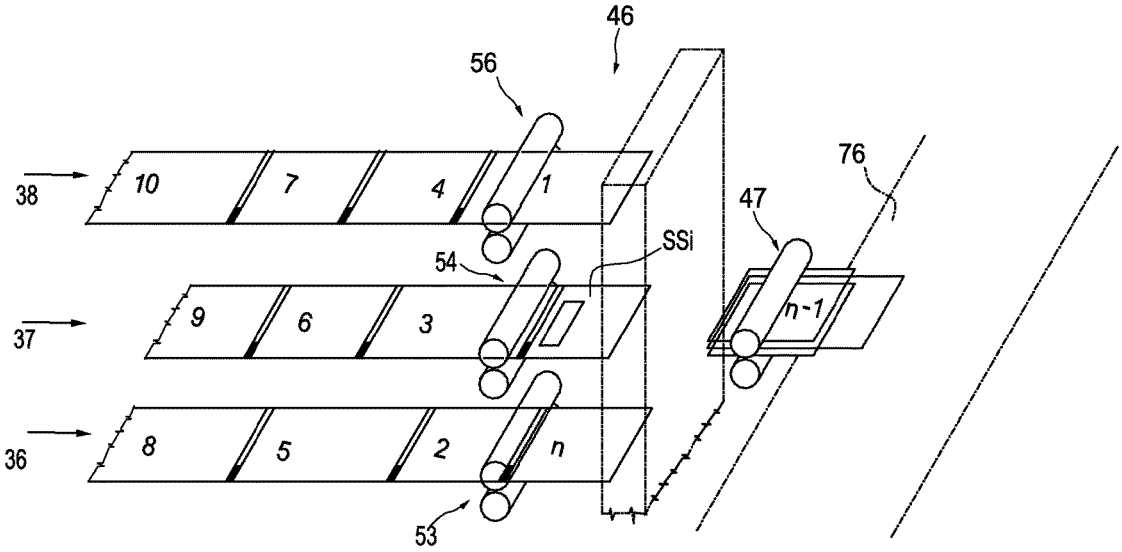
FIG. 4 represents the paper strip shown in FIG. 3 and its schematic path in a condition of use of the cutting equipment of FIG. 1.
Figure 5A:
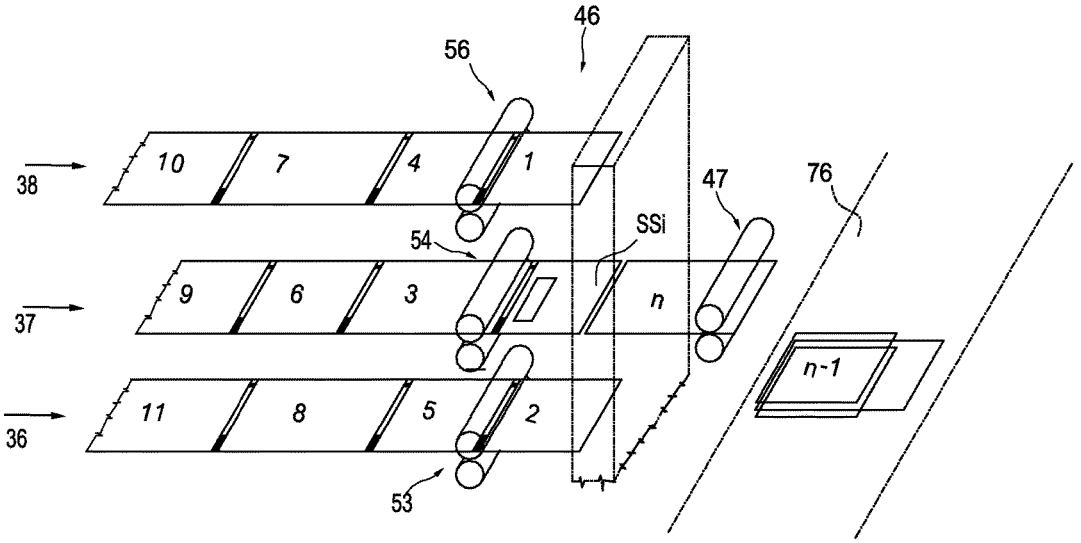
FIGS. 5*a* 5*b* show the paper strip of FIG. 4 in different operational phases.
Figure 5B:
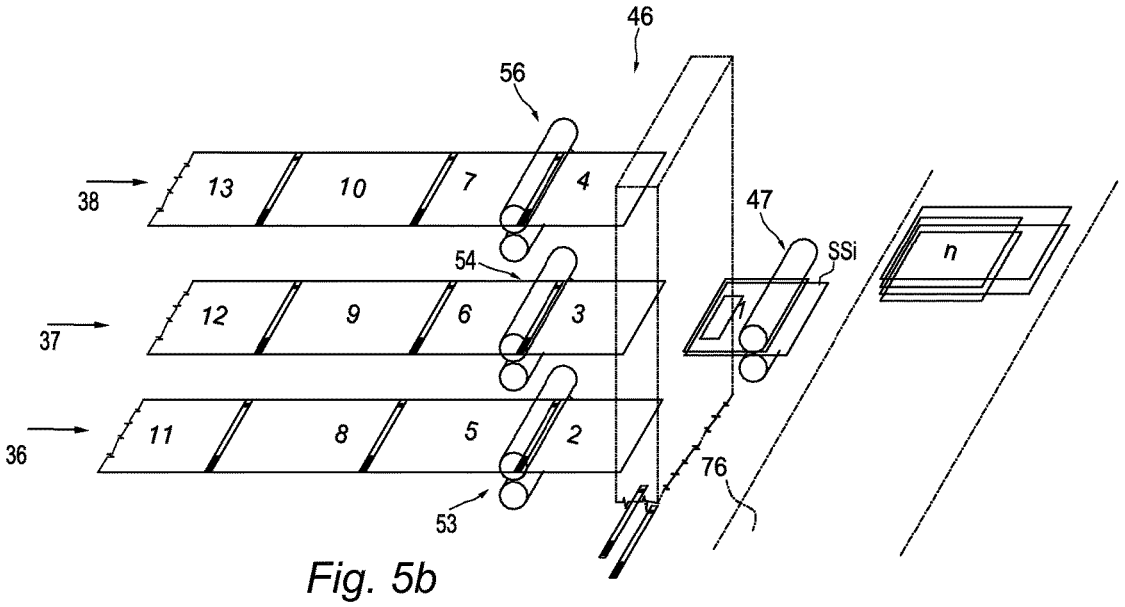

Exemplary feeding conditions of the rows 36, 37 and 38 are shown in the FIGS. 4*a*, 5*a* and 5*b*. In particular, these conditions provide cutting and grouping of print copies (images 34) of different lengths and different orders/customers, in accordance with the invention, for the cutting equipment 31.

In summary, FIG. 4 shows a condition in which the single row 36 is fed by the individual feeding mechanism 53 for cutting a last print copy (image) "n" on completion of an order/customer of which "n−1" print copies (images) were already grouped. The paper strip 33 continues to advance while the feeding mechanisms 54 and 56 are stopped and the rows 36 and 37 accumulate in the buffer device 52.

In FIG. 5*a*, the print copy "n" is extracted for stacking on the print copy "n−1", while the rows 37 and 38 advance appropriately for the cutting of the separating sheet "SSi" and the first print copy (image) "1" of a following order/customer. In FIG. 5*b*, the rows 36, 37 and 38 are moved forward while the separating sheet "SSi" and the print copy "1" are extracted for the stacking regarding the following order/customer. The rows 36, 37 and 38, are advanced in accordance with the length of the print copies (images) "2", "3" and "4" as function of the setting for the simultaneous cutting of the three rows.

The cutting sequence will proceed with advancements congruent with the lengths of the print copies (images 34) "5", "6" and "7" and simultaneous cuttings of the three rows up to completion of the order/customer, or with limited cuts to one or two rows, where the last print copy of the order/customer is flanked by the images or the separation sheet of a following order.

In accordance with the second embodiment of the invention, the cutting equipment 32 (FIG. 6) for continuous paper strips 33 operates on rows 36, 37, 38 of the paper strip in a condition of flanking.

Specifically, the cutting equipment 32 comprises a longitudinal cutting mechanism 82 for the separation of the rows 36, 37, 38 identical to the mechanism 44, the buffer device 52, individual advancement mechanisms 83, 84 and 86, a transversal cutting mechanism 87 and an electronic control unit 89.

Figure 10:
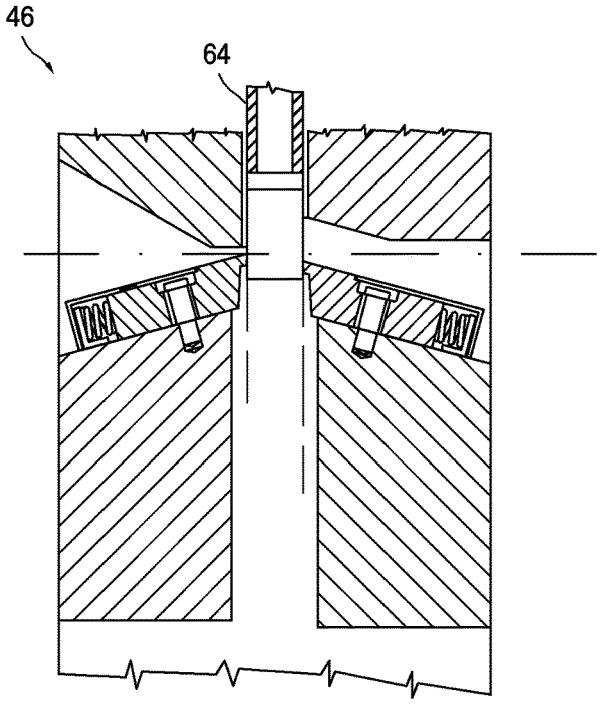
Figure 11:
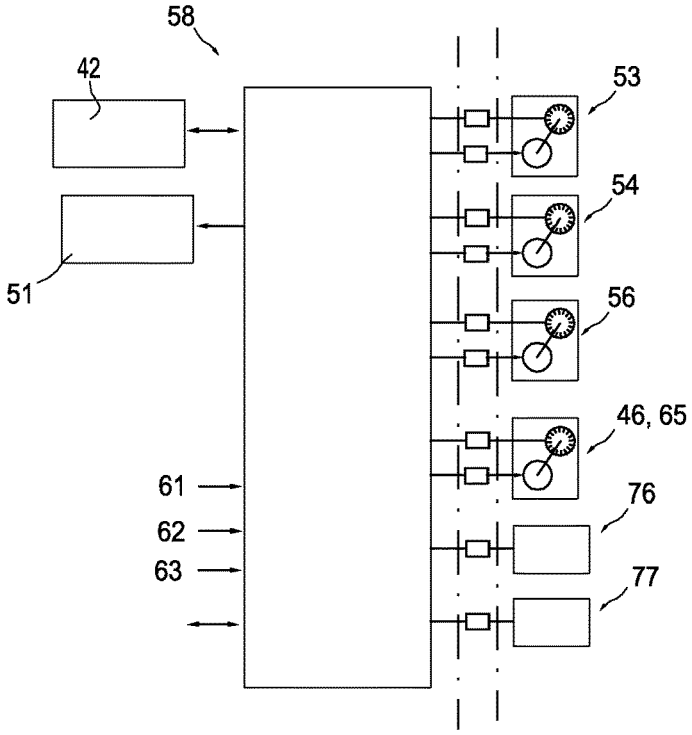
FIG. 11 represents a partial block diagram for the control of the cutting equipment of FIG. 1.
Figure 12:
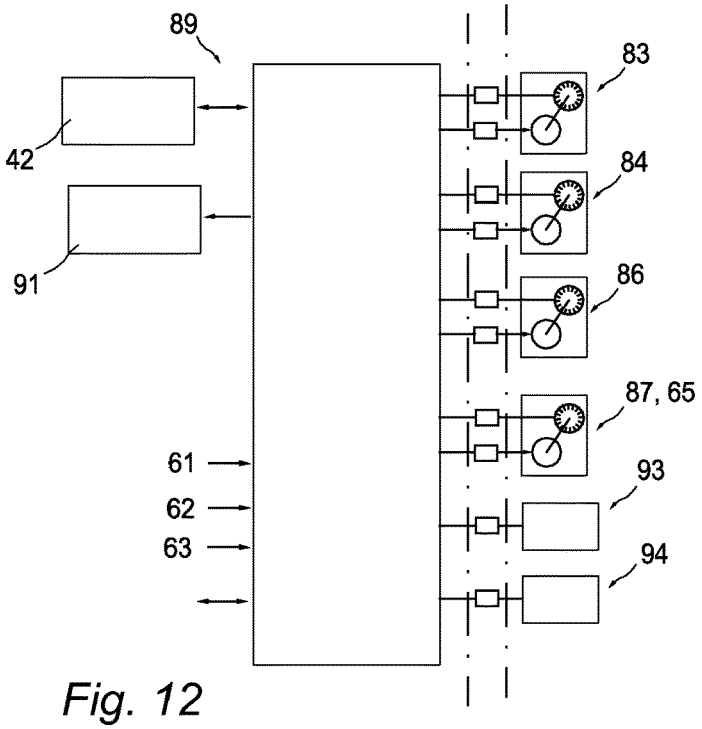
FIG. 12 is a partial block diagram for the control of the cutting equipment of FIG. 6.

Even the cutting mechanism 87 provides a transversal "guillotine" blade 64 with inclined double cutting edge shown in FIGS. 10 and 11 and actuated through the kinematic 66 by the servo controlled motor 65 or servo-controlled blades of different type. Anyway, the blade 64 or the other blades of the cutting mechanism 87 extends across the entire width of the paper strip 33.

According to the invention, also the individual feeding mechanisms 83, 84 and 86 of the cutting equipment 32 are actuatable on control of the electronic unit 89 for independently advancing the rows 36, 37, 38 with respect to the transversal cutting mechanism 87 after separation of the print copies (image 34), with compensation for the different feeding by the buffer device 52.

In the cutting equipment 32, the individual feeding mechanisms 83, 84 and 86 operate on the paper strips in condition of flanking directly to the output from the buffer device 52. Also the electronic control unit 89 actuates the feeding mechanisms 83, 84 and 86 and the transversal cutting mechanism 87 so as to present the image sheets 39 of the rows with the trailing edge "TE" aligned with the blade of the transversal cutting mechanism, as in the equipment 31.

An extraction member 91 and a waste elimination mechanism 92 controlled by the electronic unit 89 are associated to the cutting mechanism 87. The extraction member 91 is actuatable for extracting the print copies from the cutting mechanism 87 after actuation, while the waste elimination mechanism 92 is actuatable for separating from the images the trimmed parts and sections of paper strip to be discarded.

For collecting the print copies 34, overlapping means 93, a collection station 94 and a conveyor belt 95 are provided downstream from the extraction member 91 and the waste elimination mechanism 92. The overlapping means 93 guide and move the print copies 34 from the transversal cutting mechanism to the collection station 94, along paths 96, 97 and 98 with diagonal crossing in the space, as described, for example, in the Italian Patent It 1,308,720 of Tecnau Srl. The path 96 extends from a left side to a lower level of stacking as represented in FIG. 6, the path 97 extends from the center to an intermediate plane, while the path 98 extends from a right side to a higher plane.

Figure 7:
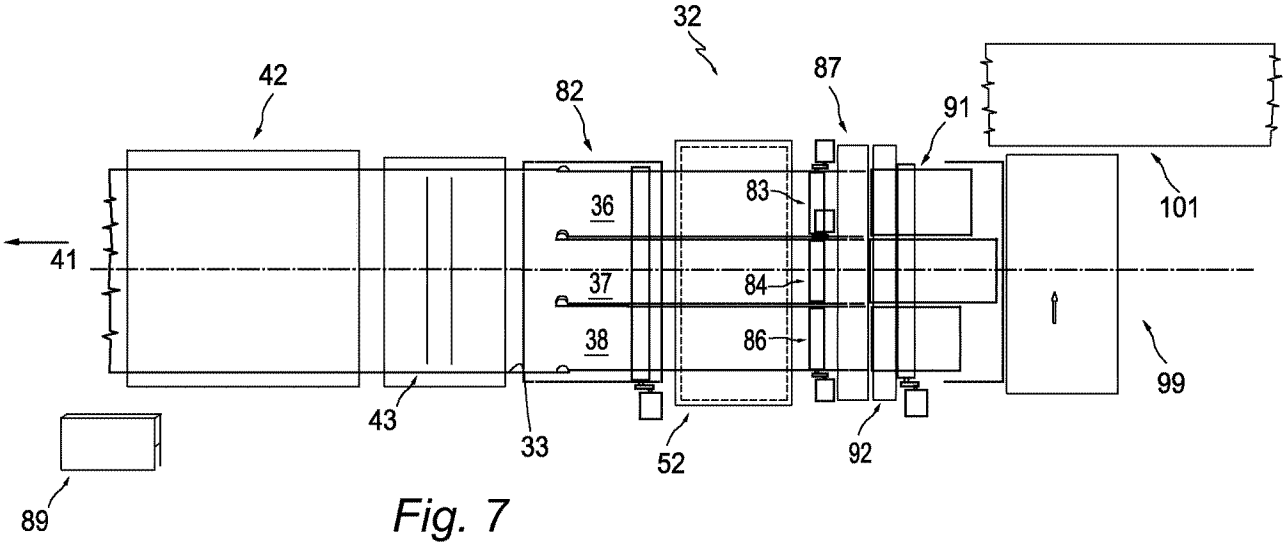
FIG. 7 shows a schematic plan view of a variant of the cutting equipment represented in FIG. 6.

According to a variant of the cutting equipment 32, a conveyor belt 99 (FIG. 7) with transversal feed direction and a collecting and stacking device 101 are provided downstream of the extraction member 91. The conveyor belt 99 and the collecting and stacking device 101 are controlled by the electronic unit 89 with function similar to that of the corresponding components of the cutting equipment 31.

In the transversal cutting mechanism 87 of the cutting equipment 32, the guillotine inclined blade 64 causes a progressive cutting that, starting from a first row of reference proceeds toward the following rows.

According to a particular variant of the cutting equipment 32, the electronic control unit 89 controls the servo-motor 65 for limiting the rotation of the eccentric member at a fraction such as to reduce the stroke of the blade 64, with a temporary arrest, to predefined values. The blade will cut only the first row or the first and the second row or all the three rows, while the extraction member 91 will extract a single print copy, or two print copies or three copies, allowing the completion, without waste, of the print copies of a given order/customer. On the contrary, the two not separated rows or the single not separated row will remain locked and will be part of the group or a part of a following order/customer.

After the partial cut of the row and the extraction of the print copy or print copies, the eccentric of control for the blade 64 of the cutting equipment 32 is restarted, with completion of the stroke of the blade, transverse cutting of the other rows or the other row and return to the condition of rest, with lifting of the blade. Then, the extraction member 91 will proceed to extract two print copies or the print copy of the new group, with clear reduction of the cutting times.

A progressive cutting can be obtained also by means of cutting mechanisms operating with circular knives or helical blades (not shown). In these cases, the electronic control unit 89 executes the partial cutting of the rows 36, 37 and 38 in the most appropriate ways in dependence of the mechanisms of actuation of the knives or blades.

Different conditions of advancing of the rows 36, 37 and 38 for the cutting equipment 32 are shown in FIGS. 8 and 8*a*-8*c*. These figures show cutting and gathering of print copies according to the invention, having different lengths and associated to different orders/customers.

Figure 8:
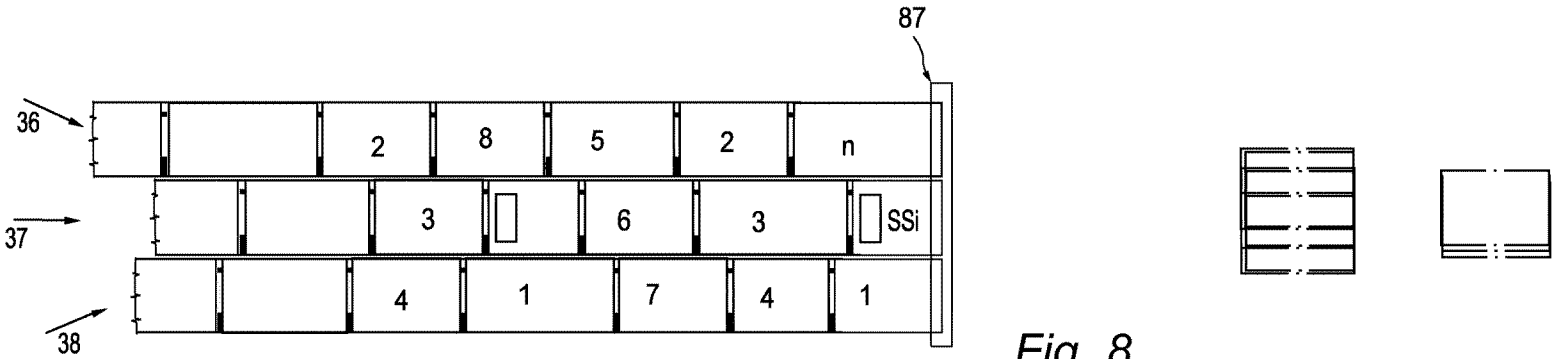
FIG. 8 represents the paper strip of FIG. 3 in a condition of use of the cutting equipment of FIG. 6 or FIG. 7.
Figure 8A:
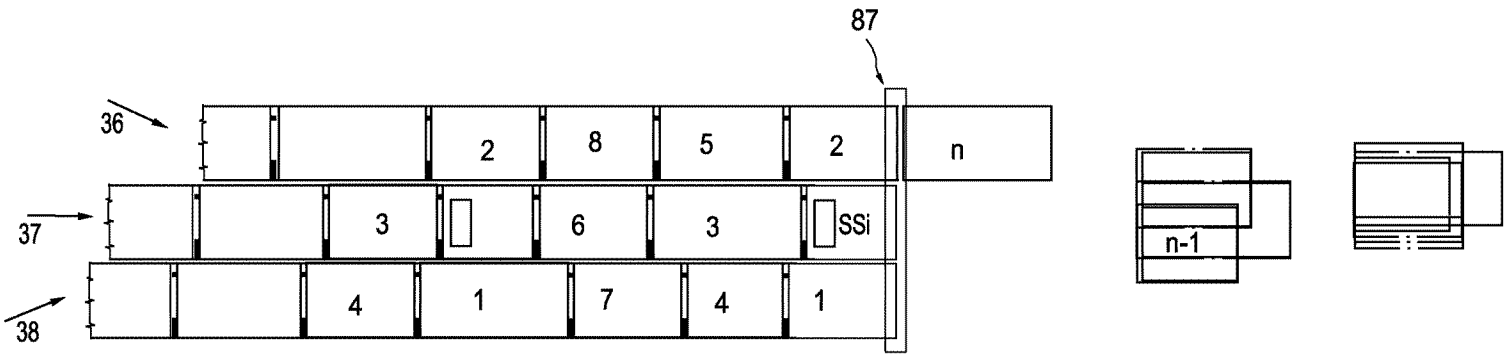
FIGS. 8*a*-8*c* show the paper strip of FIG. 8 in different operative phases.

In FIGS. 8 and 8*a* is shown the example of a condition in which only the row 36 is advanced by the individual feeding mechanism 83 for cutting a last print copy "n" on completion of a customer order of which "n−1" copies were already grouped. The paper strip 33 continues to advance; the feeding mechanisms 84 and 86 are still, while the rows 36 and 37 accumulate in the buffer device 52.

Figure 8B:
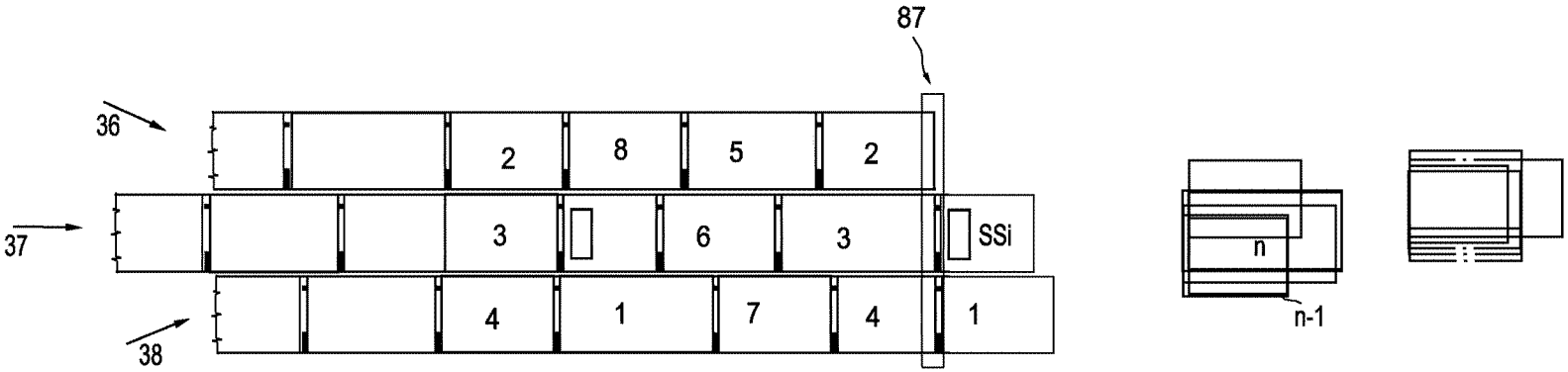
Figure 8C:
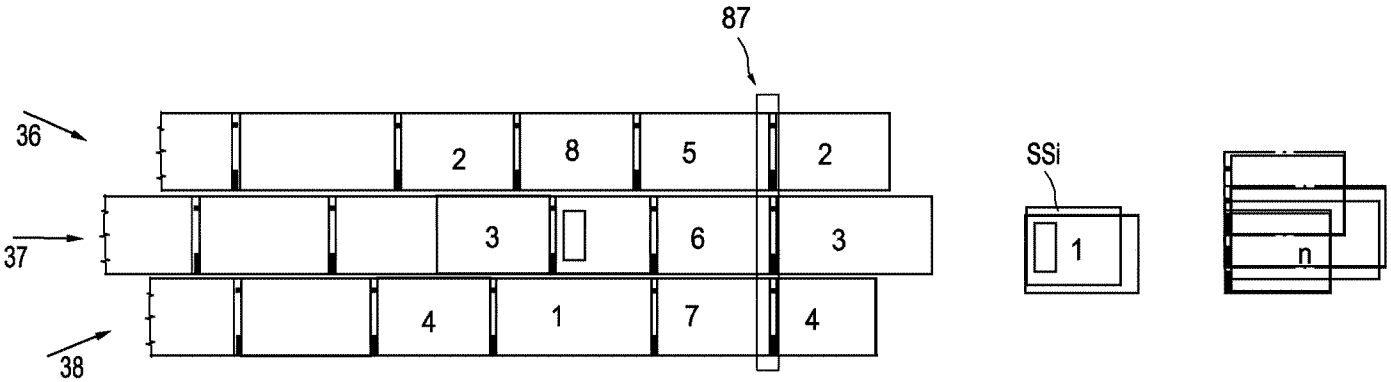
Figure 9:
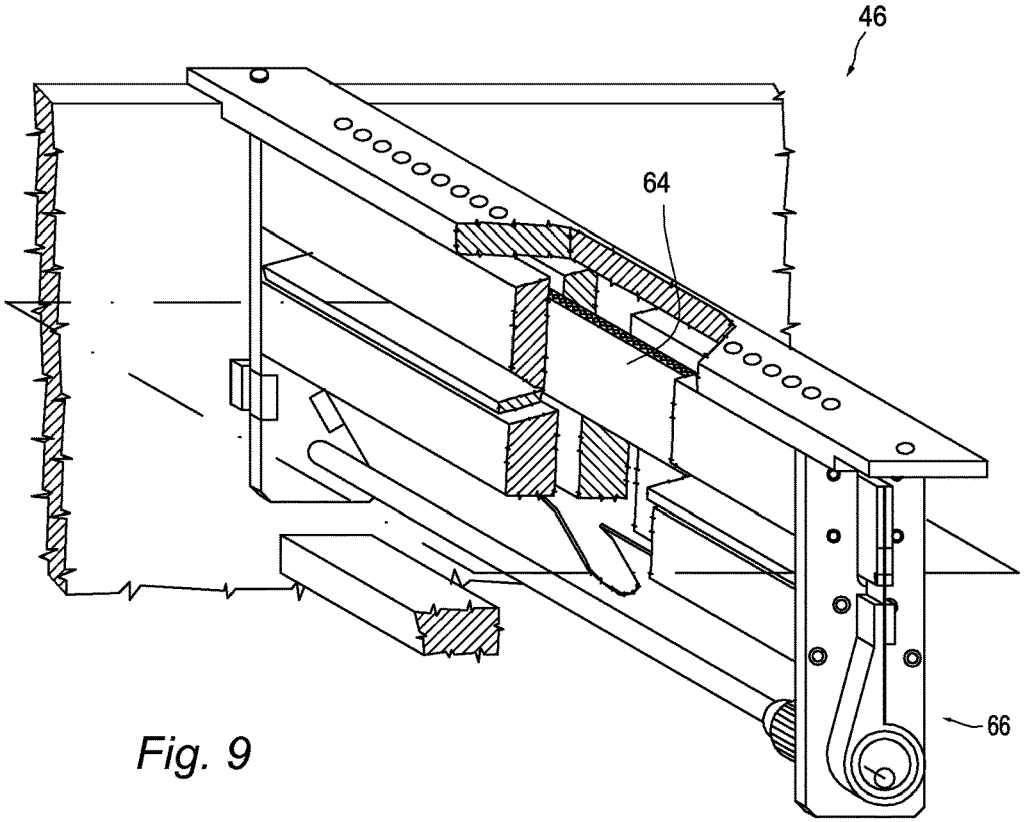
FIGS. 9 and 10 show, in enlarged scale, some details of the equipment represented in FIGS. 1 and 6.

In FIG. 8*b*, the print copy "n" is extracted for stacking on the copy "n−1", and the rows 37 and 38 are advanced appropriately for the cutting of the sheet of separation "SSi" and the first print copy "1" of the following order. In FIG. 8*c*, while the separation sheet "SSi" and the print copy "1" are extracted for the stacking of the following order/customer, the rows 36, 37 and 38 are moved forward in accordance with the length of the print copies (images) "2", "3" and "4" depending on the setting for the simultaneous cutting of the three rows. The sequence will proceed with advancements congruent with the lengths of the images "5", "6" and "7" and simultaneous cuts of the three row until completion of the order/customer, or with cuts limited to one or two rows, in the case where the latest copy of the order is flanked by images or by the separation sheet of a following order/customer.

From the above it is also clear that the method of cutting continuous paper for strips of the invention comprises the following steps:

a) providing paper strips in which the image sheets have the possibility of different longitudinal dimensions with random variations between row and row;
b) feeding, in an independent way, the rows after the separation of the image sheets;
c) providing a buffer device, upstream of the transversal cutting mechanism, to compensate for the different feeds of the rows; and
d) actuating the feeding mechanisms and the transversal cutting mechanism as a function of the codes of the images to be separated and so as to present the image sheets of the rows with aligned trailing edges for a possible simultaneous cutting by the transversal cutting mechanism.

Naturally, the principle of the invention remaining the same, the embodiments and the details of construction of the equipment and the method of cutting of the invention can broadly be varied with respect to what has been described and illustrated, by way of non-limitative example, without by this departing from the ambit of the present invention.

In particular, the equipment and the method of cutting of the invention can suitable use paper strips (not shown) having two sole rows or, with easy changes, having four or more rows and maintaining the possibility of random variations between row and row in the length of the images.

We claim:

1. A cutting equipment for continuous paper strips having image sheets with images arranged in sequence along multiple rows as portions of respective image sheets, said cutting equipment comprising a longitudinal cutting mechanism for separating the rows from said continuous paper strips, a transversal cutting mechanism actuatable for separating said image sheets with the respective images from the rows, extracting members for extracting the images from the transversal cutting mechanism, wherein said image sheets define sheet image leading edges and sheet trailing edges along said rows and said images define image leading edges and image trailing edges, wherein the image trailing edges are common to the sheet trailing edge of the respective image sheets and the image trailing edges are at given spaces from the image leading edges of the following image sheets of the row;

wherein said transversal cutting mechanism is employed with said continuous paper strips in which the image sheets have different longitudinal dimensions from a row to an adjacent row, random variations between a longitudinal position of a leading edge of the images of a row and a longitudinal position of a leading edge of the images of an adjacent row and random misalignment of the leading edges and trailing edges of the images of said rows wherein the image sheets are individually associated to image codes readable by machine and identifying the longitudinal dimensions of said images, and wherein said transversal cutting mechanism is also provided for eliminating transversal strips of the paper strip including said given spaces jointly with the separating the image sheets;

said cutting equipment further comprising:

individual feeding mechanisms for feeding, in an independent way, rows separated by the longitudinal cutting mechanism with respect to the transversal cutting mechanism;

a buffer device, upstream of the individual feeding mechanisms, for compensation of the different feeds of the rows separated by the longitudinal cutting mechanism, and an electronic control unit for the individual feeding mechanisms, the transversal cutting mechanism and said extracting members, wherein the electronic control unit responds to the image codes of the images to be separated for actuating the individual feeding mechanisms and the transversal cutting mechanism in order to present the image sheets of rows emerging from the buffer device with respective trailing edges aligned and in a predetermined cutting position with respect to the cutting mechanism and joint cutting said images with aligned trailing edges and the transversal strips irrespectively of said longitudinal dimensions; and wherein said extracting members are provided for extracting one or more images of different longitudinal dimensions and devoid of said given spaces from the cutting mechanism, after the actuation of the transversal cutting mechanism, as preparation for collecting.

2. The cutting equipment according to claim 1, wherein the image sheets are arranged along three rows of the continuous paper strips.

3. The cutting equipment according to claim 1, wherein the transversal cutting mechanism operates for the rows of said continuous paper strips in an overlapping condition.

4. The cutting equipment according to claim 3, wherein said buffer device operates on the rows, downstream of the longitudinal cutting mechanism, in a flanking condition and wherein a readdressing device is provided between the buffer device and the individual feeding mechanisms for modifying the arrangement of the rows from the flanking condition to the overlapping condition.

5. The cutting equipment according to claim 3, wherein the transversal cutting mechanism includes a single cutting edge and wherein said transversal cutting mechanism is actuated for a repeated cycle of cutting, for the separation of said transversal strips corresponding to said given spaces.

6. The cutting equipment according to claim 1, wherein the transversal cutting mechanism operates for rows of said continuous paper strips in a flanking condition.

7. The cutting equipment according to claim 6, wherein said image sheets are grouped along the continuous paper strips in corresponding order/customer groups, said order/customer groups are arranged in sequence along the continuous paper strips and wherein the transversal cutting mechanism has an inclined blade for a progressive cutting which cutting is progressive from a first row to following rows flanked to said first row and said inclined blade has two cutting edges for the separation, through single cuts, of said transversal strips of the continuous paper strips corresponding to said given spaces, and wherein the electronic control unit is provided for reducing a stroke of said inclined blade so as to prevent separation of image sheets of rows following the first row or belonging to rows following a last cut row and actuating the extracting members, for completing the collection of the images of a given order/customer group.

8. The cutting equipment according to claim 7, wherein the inclined blade is actuated, via a kinematic including an eccentric member and a connecting rod, by a closed-loop servo-motor controlled by the electronic control unit, wherein a complete stroke of the inclined blade is determined by a given rotation of said eccentric member and wherein the electronic control unit is provided for controlling the servo-motor to limit the rotation of the eccentric member at a fraction of said given rotation such as to reduce the stroke of the inclined blade, with a temporary arrest of the blade, to predefined values for cutting one row or more rows, and wherein the extraction member is provided for extracting a single image, or more images for completing the collection of the images of the given order/customer group.

9. The cutting equipment according to claim 1, wherein said image sheets are grouped along the continuous paper strips in corresponding groups of order/customer, wherein said groups extend through different length along said rows, and wherein the buffer device has a plurality of loops individually associated to said rows, wherein said loops are dimensioned to allow for each row variation of loop lengths functional to cutting of the image sheets, for completion of a given group of order/customer by compensating for different lengths of cut of the rows and such as to allow selective arrest of a row or rows with image sheets not belonging to said given group of order/customer.

10. The cutting equipment according to claim 1, wherein said image codes are printed in said given spaces of the rows and are eliminated jointly with the separation of said images.

11. The cutting equipment according to claim 1, wherein the transversal cutting mechanism includes two cutting edges for the separation, through single cuts, of said transversal strips of the paper strip corresponding to said given spaces.

12. The cutting equipment according to claim 1, wherein said image sheets are grouped along the continuous paper strips in corresponding groups of order/customer and further comprising a collecting and stacking device and a conveyor belt also controlled by the electronic control unit, wherein the conveyor belt has a feed direction transversal to that of the continuous paper strips through the transversal cutting mechanisms, and wherein the collecting and stacking device is provided for collecting, in an individualized mode, the images belonging to a given group of order/customer, and the conveyor belt is provided for transferring a collected group of images.

13. The cutting equipment according to claim 1, wherein the longitudinal cutting mechanism has a function of separating the rows from the continuous paper strips and trimming side edges of the images, wherein the image codes are printed on parts of the image sheets adjacent to one of the side edges of the respective images, and wherein the longitudinal cutting mechanism is provided for separating the parts of the image sheets including said image codes jointly with the trimming of said side edges.

14. The cutting equipment according to claim 1, wherein said image codes are printed on parts of said image sheets external to the images, particularly on said given spaces and wherein said image codes are separated upon actuation of said transversal cutting mechanism.

15. A cutting equipment for continuous paper strips with images arranged in sequence along multiple rows as portions of respective image sheets, said rows defining a first row and following adjacent rows, said cutting equipment comprising a longitudinal cutting mechanism for separating the rows from said continuous paper strips, a transversal cutting mechanism actuatable for separating image sheets with the respective images from the rows, extracting members for extracting the image sheets from the transversal cutting mechanism and an electronic control unit for the feeding mechanisms, the transversal cutting mechanism and said extracting members, wherein said image sheets are grouped in corresponding groups of order/customer arranged in sequence along the continuous paper strips and defining a first image sheet and a last image sheet; and wherein said cutting equipment is employable with said continuous paper strips in which the image sheets have different longitudinal dimensions from a row to an adjacent row, random variations between row and row, and random misalignment of leading edges and trailing edges of images of a row and images of an adjacent row;

the last image sheet of a given group of order/customer is flanked by a flanked image sheet or flanked image sheets not belonging to said given group of order/customer;

and said groups of order/customer and said image sheets are individually associated to group codes and image codes readable by machine and identifying the groups of order/customer and the longitudinal dimensions of said images, said cutting equipment further comprising individual feeding mechanisms for feeding, in an independent way, rows separated by the longitudinal cutting mechanism with respect to the transversal cutting mechanism;

a buffer device, upstream of the individual feeding mechanisms, of compensation for the different feeds of the rows;

wherein the electronic control unit responds to the image codes of the images to be separated for actuating the individual feeding mechanisms so as to present the image sheets of the rows with said trailing edges aligned with each other for a joint cutting of the image sheets by the transversal cutting mechanism;

wherein said transversal cutting mechanism includes an inclined guillotine blade extended across the entire width of the continuous paper strips and actuated through a kinematic driven by a servo-controlled motor, for a progressive cutting of the continuous paper strips with the cutting progressive from the first row to the following adjacent rows of said multiple rows;

wherein said extracting members are provided for extracting in an independent way, image sheets cut by the transversal cutting mechanism;

wherein the electronic control unit responds to the image codes of the images to be separated of a given group of order/customer for controlling said servo-controlled motor in order to reduce a stroke of said blade so as to separate image sheets of rows of said given group of order/customer including the last image sheets of said given group of order/customer without separation of the flanked image sheet or the flanked image sheets not belonging to said given group of order/customer; and wherein said electronic control unit causes the extracting members to extract only the last image sheet cut from the given group of order/customer by the transversal cutting mechanism for completing a collection of the images of said given group of order/customer.

16. The cutting equipment according to claim 15, wherein said kinematic includes an eccentric member and a connecting rod for movement of the blade, wherein a complete stroke of the blade is determined by a given rotation of said eccentric member and wherein the electronic control unit is arranged for limiting the rotation of the eccentric member at a fraction of said given rotation such as to reduce the stroke of the blade, with a temporary arrest, to predefined values provided for cutting one row or more rows.

17. The cutting equipment according to claim 15, wherein the continuous paper strips include group codes identifying said groups of order/customer and wherein the electronic control unit controls the servo-controlled motor and the extracting members for completing the collection of the images of said given group of order/customer in response to information from said group codes.

18. The cutting equipment according to claim 15, wherein the image sheets of said given group of order/customer are followed by image sheets of another group of order/customer, wherein the electronic control unit is provided for controlling the servo-controlled motor and the extracting members to complete a stroke of the blade so as to separate image sheets of rows following the first row for beginning the collection of images of said other group of order/customer.

19. The cutting equipment according to claim 15 wherein the image sheets are arranged along three rows of the continuous paper strips so that said blade can cut only a first row or the first and a second row or the three rows, and the extraction member can extract a single image, or two images or three images for completing the images of said given group of order/customer.

20. The cutting equipment according to claim 15, wherein said image sheets define sheet image leading edges and sheet trailing edges along said rows and said images define image leading edges and image trailing edges, wherein the image trailing edges are common to the sheet trailing edge of the respective image sheets and the image trailing edges are at given spaces from the image leading edges of the following image sheets of the row and wherein said blade has two cutting edges for separating said transversal strips of the continuous paper strips corresponding to said given spaces jointly to the stroke of said blade for the separation of the image sheets.

21. A cutting equipment for continuous paper strips having strips with images arranged in sequence along multiple rows as portions of respective image sheets and image codes readable by machine and identifying longitudinal dimensions of said images, said cutting equipment comprising a longitudinal cutting mechanism for separating the rows from said continuous paper strips, a transversal cutting mechanism actuatable for separating the image sheets with the respective images from the rows, extracting members for extracting the image sheets from the transversal cutting mechanism and an electronic control unit for individual feeding mechanisms, the transversal cutting mechanism and said extracting members;

wherein said image sheets are grouped in corresponding groups of order/customer arranged in sequence along the continuous paper strips, wherein each of said groups of order/customer defines a first image sheet and a last image sheet and wherein said continuous paper strips include group codes identifying said groups of order/customer;

said transversal cutting equipment is employable with the continuous paper strips in which the image sheets have different longitudinal dimensions from a row to an adjacent row, random variations between row and row with random misalignment of leading edges and trailing edges of the images of a row and the leading edges and trailing edges of the images of an adjacent row; and the transversal cutting mechanism operates for the rows of said continuous paper strips in an overlapping condition;

said cutting equipment further comprising:

the individual feeding mechanisms for feeding, in an independent way, the rows separated by the longitudinal cutting mechanism with respect to the transversal cutting mechanism;

a buffer device, upstream of the individual feeding mechanisms, of compensation for the different feeds of the rows of said groups of order/customer;

wherein the electronic control unit is provided for actuating the feeding mechanisms and the transversal cutting mechanism as a function of the image codes of the images to be separated so as to present trailing edges of said image sheets in alignment with each other for a joint cutting of the image sheets by the transversal cutting mechanism and for extracting one or more image sheets from the cutting mechanism, after the actuation of the transversal cutting mechanism; and wherein the electronic control unit, as a function of said group codes, is provided for causing the individual feeding mechanisms to feed, with respect to the transversal cutting mechanism, only a row including the last image sheet of a given group of order/customer and to arrest a row including the first image sheet of a following group of order/customer and for causing the extracting members to extract from the transversal cutting mechanism only a last cut image sheet of said given group of order/customer for completing said given group of order/customer.

22. The cutting equipment according to claim 21, wherein said groups of order/customer include respective separating sheets, wherein each one of said separating sheets is arranged between the last image sheet of a group of order/customer and the first image sheet of a following group of order/customer.

23. The cutting equipment according to claim 21, wherein said groups of order/customer occupy spread sections of predetermined lengths of the continuous paper strips with transversely aligned leading and trailing edges.

* * * * *